US005312797A

United States Patent [19]

Takiguchi et al.

[11] Patent Number: 5,312,797

[45] Date of Patent: May 17, 1994

[54] HEAT TRANSFER IMAGE-RECEIVING SHEET

[75] Inventors: R. Takiguchi; Hitoshi Saito; Masanori Torii; Jun Hasegawa; Hideo Fujimura; Yoshinori Nakamura, all of Tokyo, Japan

[73] Assignee: Dai Nippon Printing Co., Ltd., Japan

[21] Appl. No.: 855,965

[22] Filed: Mar. 23, 1992

[30] Foreign Application Priority Data

Mar. 28, 1991 [JP] Japan ..... 3-87421
Mar. 28, 1991 [JP] Japan ..... 3-87422
Nov. 8, 1991 [JP] Japan ..... 3-319665

[51] Int. Cl.[5] ..... B41M 5/035; B41M 5/038

[52] U.S. Cl. ..... 503/227; 428/195; 428/423.1; 428/480; 428/913; 428/914

[58] Field of Search ..... 8/471; 428/195, 480, 428/913, 914, 423.1; 503/227

[56] References Cited

FOREIGN PATENT DOCUMENTS 62-238790 10/1987 Japan ..... 503/227
62-294595 12/1987 Japan ..... 503/227
1-259989 10/1989 Japan ..... 503/227
1-269589 10/1989 Japan ..... 503/227

*Primary Examiner*—B. Hamilton Hess
*Attorney, Agent, or Firm*—Parkhurst, Wendel & Rossi

[57] ABSTRACT

A heat transfer image-receiving sheet for use in a heat transfer printing method using a sublimable dye, including (i) a substrate sheet and (ii) a dye-receiving layer provided on at least one surface of the substrate sheet. The dye receiving layer includes a polyester resin, wherein at least one of the diol component and the acid component of the polyester resin including an alicyclic compound. The heat transfer image-receiving sheet can produce a sharp image with a sufficiently high density, which image is excellent in fastness properties, in particular, in resistance to light, resistance to sebum and sweat and resistance to plasticizer.

10 Claims, No Drawings

HEAT TRANSFER IMAGE-RECEIVING SHEET

BACKGROUND OF THE INVENTION

The present invention relates to a heat transfer image-receiving sheet, and more particularly to a heat transfer image-receiving sheet capable of producing an image which is excellent in color density, sharpness and fastness properties, in particular, in resistance to light, resistance to sebum and sweat, resistance to plasticizer, resistance to oils and resistance to heat.

Heretofore, a variety of heat transfer printing methods have been known. One of them is a method in which a heat transfer sheet comprising as a recording agent a sublimable dye which is retained by a substrate sheet such as a polyester film, used in combination with an image-receiving sheet capable of being dyed with the sublimable dye, prepared by providing a dye-receiving layer on a substrate sheet such as paper or a plastic film to produce various full-colored images on the image-receiving sheet.

In the above method, a thermal head of a printer is employed as a heat application means, and a large number of dots in three or four colors are transferred to the image-receiving sheet in an extremely short heat application time. A full-colored original image can thus be successfully reproduced on the image-receiving sheet.

The image thus produced is excellent in sharpness and clarity because a dye is used as a coloring agent. Therefore, the heat transfer printing method of this type can produce an excellent half-tone image with continuous gradation, comparable to an image obtained by offset printing or gravure printing. Moreover, the quality of the image is as high as that of a full-colored photograph.

In the above heat transfer printing method, not only the structure of the heat transfer sheet but also that of the image-receiving sheet on which an image is produced is an important factor.

Conventional heat transfer image-receiving sheets disclosed, for instance, in Japanese Laid-Open Patent Publication Nos. 169370/1982, 207250/1982 and 25793/1985 comprise a dye-receiving layer which is formed using a resin selected from polyester resins, vinyl resins such as a polyvinyl chloride resin, polycarbonate resins, polyvinyl butyral resins, acrylic resins, cellulose resins, olefin resins and polystyrene resins.

The above heat transfer image-receiving sheets, however, are disadvantageous in that their dye-receiving layers are poor in dye-receptivity, and that images produced therein are insufficient in fastness properties and preservability. It is therefore required to find materials suitable for a dye-receiving layer which is free from all the above problems.

The use of a resin having high dye-receptivity or the incorporation of a plasticizer may be effective to form a dye-receiving layer having high dye-receptivity. This is because a dye thermally transferred to such a dye-receiving layer can easily diffuse therein. However, an image produced in the dye-receiving layer formed using a resin having high dye-receptivity tends to blur in the course of the preservation thereof. In other words, such a dye-receiving layer is poor in the preservability of images. Moreover, the dye cannot be well fixed in the dye-receiving layer, so that it tends to bleed on the surface of the dye-receiving layer. As a result, an object which is brought into contact with the dye-receiving layer is stained with the dye.

To solve the above problems, the dye-receiving layer may be formed using a resin which does not allow the dye to easily migrate in the dye-receiving layer. However, the dye-receiving layer formed using such a resin is poor in dye-receptivity and cannot produce a highly sharp image with a high optical density.

There are some other problems in the prior art. Light resistance of the dye transferred to the dye-receiving layer is insufficient. In the case where the image-recorded surface of the dye-receiving layer is touched with fingers, the image undergoes a change in color or the dye-receiving layer itself swells or cracks due to sweat and sebum deposited by the fingers (resistance to such sweat and sebum is hereinafter referred to as "resistance to fingerprint"). Furthermore, when the dye-receiving layer is brought into contact with an article containing a plasticizer such as a plastic eraser or a product of a soft vinyl chloride resin (ex. telephone cord), the dye tends to migrate to the article. In other words, the dye-receiving layer has the problem of low resistance to plasticizer.

A polyester resin is conventionally known as a resin capable of forming a dye-receiving layer which is excellent in the above-described dye-receptivity, dye-fixating ability, resistance to fingerprint and resistance to plasticizer.

However, the light resistance of an image produced in a dye-receiving layer formed using a polyester resin is inferior to that of an image produced in a dye-receiving layer formed using a polyvinyl butyral resin or a polycarbonate resin. Further, although resistances to fingerprint and to plasticizer (oils) of the image produced in the dye-receiving layer formed using a polyester resin are superior to those of the image produced in a dye-receiving layer formed using a polycarbonate resin, a polyvinyl butyral resin or the like, they are unsatisfactory. The resistances to light, to plasticizer and to fingerprint greatly depend on the chemical structure of a resin which is used for forming the dye-receiving layer.

SUMMARY OF THE INVENTION

Accordingly, an object of the present invention is to provide a heat transfer image-receiving sheet for use in a heat transfer printing method using a sublimable dye, capable of producing a sharp image with a sufficiently high density, which image is excellent in fastness properties, in particular, in resistance to light, resistance to fingerprint and resistance to plasticizer.

The above object can be attained by a heat transfer image-receiving sheet comprising (i) a substrate sheet and (ii) a dye-receiving layer provided on at least one surface of the substrate sheet, comprising a polyester resin, at least one of the diol component and the acid component of the polyester resin comprising an alicyclic compound.

The object of the invention can also be attained by a heat transfer image-receiving sheet comprising (i) a substrate sheet and (ii) a dye-receiving layer provided on at least one surface of the substrate sheet, comprising a polyester resin and a polyurethane resin whose diol component comprises a compound having the following formula:

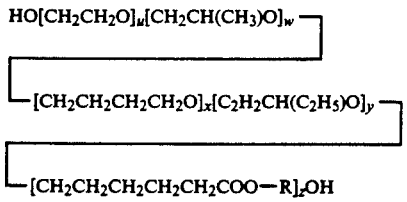

wherein u, w, x, y and z respectively represent an integer of 0 to 10, provided that at least one of u, w, x, y and z is not 0, and R is an alkylene group, a phenylene group or an alkylene oxide group.

BEST MODE FOR CARRYING OUT THE INVENTION

The present invention will now be explained in detail with reference to the preferred embodiments.

The heat transfer image-receiving sheet according to the present invention comprises a substrate sheet and a dye-receiving layer provided on at least one surface of the substrate sheet.

Examples of material for the substrate sheet include synthetic paper (polyolefin type, polystyrene type, etc.), high quality paper, art paper, coated paper, cast-coated paper, wallpaper, backing paper, paper impregnated with a synthetic resin or emulsion, paper impregnated with a synthetic rubber latex, paper containing a synthetic resin, cardboard, cellulose fiber paper, and sheets or films of plastics such as polyolefin, polyvinyl chloride, polyethylene terephthalate, polystyrene, polymethacrylate and polycarbonate. In addition, a white opaque film prepared by adding a white pigment or filler to any of the above-enumerated synthetic resins, or an expanded sheet prepared by expanding any of the synthetic resins is also employable as the substrate sheet. Thus, no particular limitation is imposed on the material for the substrate sheet.

Furthermore, a laminate prepared by the combination use of any of the above-described sheets and films can also be used as the substrate sheet. Typical examples of the laminate are a laminate of cellulose fiber paper and synthetic paper, and a laminate of cellulose fiber paper and a plastic film or sheet.

There is no limitation on the thickness of the substrate sheet. However, the thickness is, in general, in the range of approximately from 10 to 300 μm.

In the case where satisfactorily high adhesion cannot be obtained between the substrate sheet and the dye-receiving layer, it is preferable to subject the surface of the substrate sheet on which the dye-receiving layer is provided to a primer treatment or a corona discharge treatment.

The dye-receiving layer provided on the surface of the substrate sheet receives a sublimable dye transferred from a heat transfer sheet, and retains an image produced therein.

In the present invention, a polyester resin, at least one of its diol component and acid component being an alicyclic compound, is mainly used for forming the dye-receiving layer.

Any alicyclic compound can be used as the acid component as long as it has two or more carboxyl groups, and as the diol component as long as it has two or more hydroxyl groups. However, preferred examples of the alicyclic compound for use in the present invention include tricyclodecanedimethanol (abbreviated to "TCM-D"), cyclohexanedicarboxylic acid, cyclohexanedimethanol and cyclohexanediol. A particularly preferable diol is tricyclo[5.2.1.$0^{2,6}$]decane-4,8-dimethanol (TCD-M) having the following formula:

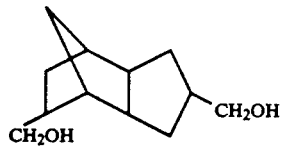

TCD-M can contribute to an improvement in the resistance to light.

In the present invention, another acid or diol component can also be used as long as the above-described compound is used as an essential acid or diol component. Examples of such a diol include ethylene glycol, neopentyl glycol, diethylene glycol, propylene glycol, dipropylene glycol, tripropylene glycol, 2,3,4-trimethyl-1,3-pentanediol, 3-methylpentene-1,5-diol, 1,4-cyclohexanedimethanol, an addition product of bisphenol A or hydrogenated bisphenol A to ethylene oxide or propylene oxide, polyethylene glycol, polypropylene glycol, polytetramethylene glycol, polybutylene glycol, 2,2-diethyl-1,3-propanediol and 2-n-butyl-ethyl-1,3-propanediol.

The above-described nonessential diol can be used in the range of 0% to 90% by weight of the total weight of the diol components. To greatly improve the resistances to fingerprint and to plasticizer, it is preferable to make the whole diol component contain 60 to 90 mol % of ethylene glycol. When the rate of ethylene glycol is higher than the above range, the resistances to light and to heat cannot be satisfactorily improved. If the resistances to light and to heat are regarded as particularly important, it is preferable to make the rate of the alicyclic compound higher.

Examples of an acid component, other than cyclohexane-dicarboxylic acid, to be reacted with the above diol include aromatic dicarboxylic acids such as terephthalic acid, isophthalic acid, orthophthalic acid and 2,6-naphthalic acid, aromatic oxycarboxylic acids such as p-oxybenzoic acid and p-(hydroxyethoxy)benzoic acid, aliphatic dicarboxylic acids such as succinic acid, adipic acid, azelaic acid, sebacic acid and dodecanedicarboxylic acid, unsaturated aliphatic and aliphatic dicarboxylic acids such as fumaric acid, maleic acid, itaconic acid, tetrahydrophthalic acid and 1,4-cyclohexanedicarboxylic acid, and tri- and tetracarboxylic acids such as trimellitic acid, trimesic acid and pyromellitic acid. Of these polycarboxylic acids, aromatic dicarboxylic acids are preferred.

The polyester resin for use in the present invention can be prepared by a known method such as dehydration condensation, transesterification condensation or the like. It is preferable that the polyester resin have a number-average molecular weight of 2,000 to 30,000 and a glass transition temperature (Tg) of 70° to 90° C.

In the present invention, the above polyester resin can be used as it is, but modified one such as a urethane-modified polyester resin can also be used. Furthermore, the polyester resin can be used singly, but a mixture of the polyester resins is also employable. In addition, another thermoplastic resin can also be used together with the polyester resin. Examples of the thermoplastic resin include polyolefin resins such as polypropylene, halogenated polymers such as polyvinyl chloride and polyvinylidene chloride, vinyl polymers such as polyvinyl acetate, polyacrylic ester and polyvinyl acetal, polyester resins such as polyethylene terephthalate and polybutylene terephthalate, polystyrene resins, polyamide resins, copolymeric resins of an olefin such as ethylene or propylene and another vinyl monomer, ionomers, cellulose resins such as cellulose diacetate and polycarbonate resins.

According to the other embodiment of the present invention, a polyester resin and a polyurethane resin are used for forming the dye-receiving layer. It is preferable that these resins be in a chemically bonded state, that is, in a state of a urethane-modified polyester resin. However, a mixture of a polyester resin and a polyurethane resin is also employable. The polyester resin for use in this embodiment is prepared by reacting a diol component with a polycarboxylic acid component in accordance with an ordinary method. A commercially available polyester resin can also be used in the present invention.

Preferred examples of the diol component include ethylene glycol, neopentyl glycol, diethylene glycol, propylene glycol, dipropylene glycol, tripropylene glycol, 2,3,4-trimethyl-1,3-pentanediol, 3-methylpentene-1,5-diol, 1,4-cyclohexanedimethanol, an addition product of bisphenol A or hydrogenated bisphenol A to ethylene oxide or propylene oxide, polyethylene glycol, polypropylene glycol, polytetramethylene glycol, polybutylene glycol, 2,2-diethyl-1,3-propanediol and 2-n-butylethyl-1,3-propanediol.

Examples of the polycarboxylic acid component to be reacted with the above diol include-aromatic dicarboxylic acids such as terephthalic acid, isophthalic acid, orthophthalic acid and 2,6-naphthalic acid, aromatic oxycarboxylic acids such as p-oxybenzoic acid and p-(hydroxyethoxy)benzoic acid, aliphatic dicarboxylic acids such as succinic acid, adipic acid, azelaic acid, sebacic acid and dodecanedicarboxylic acid, unsaturated aliphatic and aliphatic dicarboxylic acids such as fumaric acid, maleic acid, itaconic acid, tetrahydrophthalic acid and 1,4-cyclohexanedicarboxylic acid, and tri- and tetracarboxylic acids such as trimellitic acid, trimesic acid and pyromellitic acid. Of these polycarboxylic acids, aromatic dicarboxylic acids are particularly preferred.

The polyester resin can be prepared by a known method such as dehydration condensation, transesterification condensation or the like. It is preferable that the polyester resin have a molecular weight of 15,000 to 25,000 and a glass transition temperature (Tg) of 70° to 90° C.

To obtain a urethane-modified polyester resin, it is preferable to successively add a diol and polyisocyanate to the reaction system after the above polyester resin is obtained. However, it is also possible to modify a commercially available polyester resin. When the above modification is conducted, a chain-lengthening agent such as polyamine or polyol may be added to the reaction system to increase the molecular weight of the polyurethane moiety.

The diol for use in the above reaction is a compound having the following formula:

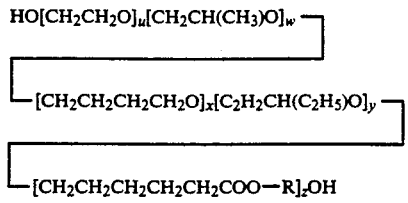

wherein u, w, x, y and z are the same as before. Polyethylene glycol, polypropylene glycol, polytetramethylene glycol or polycaprolactone diol having a molecular weight of approximately 200 to 1,000 is preferably used as the diol.

Examples of the polyisocyanate for use in the above reaction include hexamethylene diisocyanate, tetramethylene diisocyanate, 3,3-dimethoxy-4,4-biphenylene diisocyanate, p-xylylene diisocyanate, m-xylylene diisocyanate, 1,3-diisocyanatetrimethylcyclohexane, 4,4-diisocyanatecyclohexane, isophorone diisocyanate, 2,4-tolylene diisocyanate, 2,6-tolylene diisocyanate, p-phenylene diisocyanate, diphenylmethane diisocyanate, m-phenylene diisocyanate, 2,4-naphthalene diisocyanate, 3,3-dimethyl-4,4-biphenylene diisocyanate, 4,4-diisocyanatediphenyl ether and 1,5-naphthalene diisocyanate.

The polyurethane resin and the polyester resin are preferably in the weight ratio 100:(10 to 50). In the case where the amount of the polyurethane is too small, an improvement in the resistance to oils cannot be successfully achieved.

The above-described urethane-modified polyester can be used singly, but a mixture of the urethane-modified polyesters is also employable. Moreover, another thermoplastic resin can also be used together with the urethane-modified polyester. In this case, the amount of the thermoplastic resin is 50 parts by weight or less for 100 parts by weight of the urethane-modified polyester. Examples of the thermoplastic resin include polyolefin resins such as polypropylene, halogenated polymers such as polyvinyl chloride and polyvinylidene chloride, vinyl polymers such as polyvinyl acetate and polyacrylic ester, polyester resins such as polyethylene terephthalate and polybutylene terephthalate, polystyrene resins, polyamide resins, copolymeric resins of an olefin such as ethylene or propylene and another vinyl monomer, ionomers, cellulose resins such as cellulose diacetate and polycarbonate resins.

The heat transfer image-receiving sheet of the present invention can be obtained in the following manner:

The above-described polyester resin and other necessary additives such as a releasing agent, a crosslinking agent, a hardening agent, a catalyst, a heat-releasing agent, an ultraviolet-absorbing agent, an antioxidant and a photostabilizer are dissolved in a proper organic solvent or dispersed in an organic solvent or water. The resulting solution or dispersion is coated onto at least one surface of the substrate sheet by means of a gravure printing method, a screen printing method or a reverse roll coating method using a gravure, and then dried to form the dye-receiving layer.

A pigment or a filler such as titanium oxide, zinc oxide, kaoline clay, calcium carbonate, or fine powder of silica may also be incorporated into the dye-receiving layer. The whiteness of the dye-receiving layer is thus increased, and the sharpness of an image produced therein is enhanced.

There is no limitation on the thickness of the dye-receiving layer. However, the thickness is, in general, from 1 to 50 μm. It is preferable that the dye-receiving layer be a continuous layer. However, it can also be made into a discontinuous layer using an emulsion or dispersion of the resin.

By properly selecting the material for the substrate sheet, the heat transfer image-receiving sheet of the present invention is utilizable for a variety of purposes, such as cards and transparent sheets in which an image can be thermally produced.

A cushion layer may be interposed between the substrate sheet and the dye-receiving layer, if necessary. The cushion layer absorbs noises which are made when printing is conducted. Therefore, when such a layer is provided, an original image can be reproduced in the dye-receiving layer with high fidelity.

Together with the heat transfer image-receiving sheet according to the present invention, a heat transfer sheet comprising a dye layer containing a sublimable dye, provided on a substrate sheet such as paper or a polyester film is used for heat transfer printing. Any conventional heat transfer sheet can be used as it is.

To conduct the heat transfer printing, any conventionally known heat-application means can be employed. For instance, the purpose can be fully attained by applying thermal energy in an amount of approximately 5 to 100 mJ/mm$^2$, which can be controlled by changing the printing time, using a printing apparatus such as a thermal printer, for instance, a "Video Printer VY-100" (Trademark) manufactured by Hitachi Co., Ltd.

The present invention will now be explained more specifically with reference to Examples and Comparative Examples. However, the following Examples should not be construed as limiting the present invention. Throughout the examples, quantities expressed in "part(s)" and "percent (%)" are on the weight basis, unless otherwise indicated.

REFERENTIAL EXAMPLE A1

50 mol of dimethylterephthalic acid, 50 mol of dimethylisophthalic acid, 90 mol of TCD-M, 10 mol of ethylene glycol and 0.5 mol of tetrabutoxy titanate serving as a catalyst were placed in an autoclave equipped with a thermometer and a stirrer. The mixture was heated to a temperature of 150° to 220° C. for 3 hours to cause transesterification. The temperature of the reaction system was then raised to 250° C. over a period of 30 minutes, and the pressure of the system was gradually reduced to 0.3 mmHg or less over a period of 45 minutes. The reaction was continued for 90 minutes under these conditions, thereby obtaining a light yellow transparent polyester resin, Polyester Resin A1, having a molecular weight of 18,000.

The polyester resins shown in Table A1 were respectively prepared in the same manner as the above.

TABLE A1

| Number | Ingredients | Amount Used |
|---|---|---|
| A1 | TCD-M | 90 mol |
| | Neopentyl glycol | 10 mol |
| | Terephthalic acid | 50 mol |
| | Isophthalic acid | 50 mol |
| A2* | TCD-M | 90 mol |
| | Neopentyl glycol | 10 mol |
| | Terephthalic acid | 50 mol |
| | Isophthalic acid | 50 mol |
| | Isophorone diisocyanate | 20 mol |

TABLE A1-continued

| Number | Ingredients | Amount Used |
|---|---|---|
| | Neopentyl glycol | 10 mol |
| A3 | TCD-M | 100 mol |
| | Ethylene glycol | 20 mol |
| | Fumaric acid | 40 mol |
| | Terephthalic acid | 20 mol |
| | Isophthalic acid | 40 mol |
| A4 | TCD-M | 20 mol |
| | Ethylene glycol | 20 mol |
| | BEP-20 (bisphenol) | 80 mol |
| | Fumaric acid | 100 mol |
| A5 | TCD-M | 20 mol |
| | Ethylene glycol | 100 mol |
| | Fumaric acid | 100 mol |
| A6 | TCD-M | 40 mol |
| | Ethylene glycol | 80 mol |
| | Fumaric acid | 100 mol |
| A7 | TCD-M | 60 mol |
| | Ethylene glycol | 80 mol |
| | Fumaric acid | 100 mol |
| A8 | TCD-M | 80 mol |
| | Ethylene glycol | 40 mol |
| | Fumaric acid | 100 mol |
| A9 | TCD-M | 20 mol |
| | BPE-20 (bisphenol) | 100 mol |
| | Fumaric acid | 100 mol |
| A10 | TCD-M | 50 mol |
| | Ethylene glycol | 20 mol |
| | BPE-20 (bisphenol) | 20 mol |
| | Fumaric acid | 40 mol |
| | Terephthalic acid | 20 mol |
| | Isophthalic acid | 40 mol |
| A11 | TCD-M | 100 mol |
| | Ethylene glycol | 20 mol |
| | Terephthalic acid | 20 mol |
| | Isophthalic acid | 80 mol |
| Comparative Example A1 | Ethylene glycol | 20 mol |
| | BPE-20 (bisphenol) | 100 mol |
| | Terephthalic acid | 20 mol |
| | Isophthalic acid | 80 mol |
| Comparative Example A2 | Ethylene glycol | 50 mol |
| | Neopentyl glycol | 50 mol |
| | Terephthalic acid | 50 mol |
| | Isophthalic acid | 50 mol |
| Comparative Example A3 | Ethylene glycol | 50 mol |
| | BPE-20 (bisphenol) | 50 mol |
| | Fumaric acid | 40 mol |
| | Terephthalic acid | 20 mol |
| | Isophthalic acid | 40 mol |
| Comparative Example A4 | Ethylene glycol | 50 mol |
| | BPE-20 (bisphenol) | 50 mol |
| | Fumaric acid | 100 mol |

*The polyester resin obtained was reacted with isophorone diisocyanate and neopentyl glycol to give a urethane-modified polyester resin.

EXAMPLES A1 TO A11 AND COMPARATIVE EXAMPLES A1 TO A4

Preparation of Heat Transfer Image-Receiving Sheets

A coating liquid for forming a dye-receiving layer, having the following formulation was coated onto one surface of a substrate sheet, synthetic paper with a thickness of 110 μm manufactured by Oji-Yuka Synthetic Paper Co., Ltd., by a wire bar in an amount of 5.0 g/m$^2$ on dry basis, dried, and hardened to form a dye-receiving layer on the substrate sheet. Thus, heat transfer image-receiving sheets according to the present invention and comparative ones were respectively obtained.

| Formulation of Coating Liquid: | |
|---|---|
| Polyester resin shown in Table A1 | 13.4 parts |
| Amino-modified silicone ("KF-393" (Trademark) manufactured by Shin-Etsu Chemical Co., Ltd.) | 0.25 parts |

-continued

| Formulation of Coating Liquid: | |
|---|---|
| Epoxy-modified silicone ("X-22-343" (Trademark) manufactured by Shin-Etsu Chemical Co., Ltd.) | 0.25 parts |
| Methyl ethyl ketone/Toluene (weight ratio = 1:1) | 84.8 parts |

Preparation of Heat Transfer Sheet

An ink composition for forming a dye-supporting layer, having the following formulation was prepared, and coated onto the surface of a substrate sheet, a polyethylene terephthalate film having a thickness of 6 μm with its back surface imparted with heat-resistivity, by a wire bar in an amount of 1.0 g/m$^2$ on dry basis, and then dried to form a dye-supporting layer on the substrate sheet. A heat transfer sheet was thus obtained.

| Formulation of Ink Composition: | |
|---|---|
| C.I. Disperse Blue 24 | 1.0 part |
| Polyvinyl butyral resin | 10.0 parts |
| Methyl ethyl ketone/Toluene (weight ratio = 1:1) | 90.0 parts |

Heat Transfer Printing Test

Each of the heat transfer image-receiving sheets obtained in Examples A1 to A11 and Comparative Examples A1 to A4 was superposed on the above-obtained heat transfer sheet so that the dye-receiving layer faced the dye-supporting layer. Thermal energy was then applied to the back surface of the heat transfer sheet by a thermal head under the following conditions:

| | |
|---|---|
| Electric voltage applied: | 12.0 V |
| Pulse width: | 16 msec |
| Dot density: | 6 dot/line |

The images thus obtained were evaluated in terms of the optical density, resistance to light and resistance to heat in accordance with the following manners. The results are shown in Table A2.

(1) Optical Density (O.D.)

The optical reflection density of each of the printed images was measured by a MacBeth densitometer "RD-914" (Trademark). The optical density of the image printed using the image-receiving sheet obtained in Comparative Example A1 was indicated by "1.00", and the optical densities of the images printed using the other image-receiving sheets were indicated by values relative to it.

(2) Resistance to Light

The printed image was exposed to a xenon light with an energy of 70 kJ, and the color-fading rate of the image was determined by a fadeometer, "CI-35A" (Trademark) manufactured by Atlas Corp.

(3) Resistance to Heat

The image-receiving sheet bearing the image was preserved in a dried atmosphere at a temperature of 60° C. for 200 hours, and the color-fading rate of the image was determined.

TABLE A2

| Image-Receiving Sheet | Polyester Resin | Relative Optical Density | Resistance to Light | Resistance to Heat |
|---|---|---|---|---|
| Example A1 | 1 | 1.01 | 9% | 3% |
| Example A2 | 2 | 1.03 | 8% | 4% |
| Example A3 | 3 | 0.95 | 10% | 3% |
| Example A4 | 4 | 1.02 | 11% | 5% |
| Example A5 | 5 | 1.11 | 10% | 4% |
| Example A6 | 6 | 1.03 | 9% | 4% |
| Example A7 | 7 | 1.01 | 9% | 3% |
| Example A8 | 8 | 0.98 | 8% | 4% |
| Example A9 | 9 | 0.95 | 8% | 4% |
| Example A10 | 10 | 0.92 | 9% | 4% |
| Example A11 | 11 | 0.90 | 8% | 3% |
| Comparative Example A1 | 1 | 0.92 | 39% | 15% |
| Comparative Example A2 | 2 | 1.10 | 22% | 9% |
| Comparative Example A3 | 3 | 0.95 | 35% | 12% |
| Comparative Example A4 | 4 | 1.11 | 19% | 10% |

REFERENTIAL EXAMPLE A2

The polyester resins shown in Table A3 were respectively prepared in the same manner as in Referential Example A1.

TABLE A3

| Number | Ingredients | Amount Used |
|---|---|---|
| A12 | Ethylene glycol | 65 mol |
| | Cyclohexanedimethanol | 35 mol |
| | Terephthalic acid | 100 mol |
| A13 | Ethylene glycol | 65 mol |
| | Cyclohexanedimethanol | 35 mol |
| | Terephthalic acid | 50 mol |
| | Isophthalic acid | 50 mol |
| A14 | Ethylene glycol | 65 mol |
| | Cyclohexanedimethanol | 35 mol |
| | Terephthalic acid | 89 mol |
| | Sebacic acid | 11 mol |
| A15 | Ethylene glycol | 75 mol |
| | Cyclohexanedimethanol | 25 mol |
| | Terephthalic acid | 50 mol |
| | Cyclohexanedicarboxylic acid | 50 mol |
| A16 | Ethylene glycol | 70 mol |
| | Cyclohexanedimethanol | 30 mol |
| | Terephthalic acid | 50 mol |
| | Cyclohexanedicarboxylic acid | 50 mol |
| A17 | TCD-M | 40 mol |
| | Ethylene glycol | 60 mol |
| | Terephthalic acid | 50 mol |
| | Isophthalic acid | 48 mol |
| | Trimellitic acid | 2 mol |
| A18 | TCD-M | 20 mol |
| | Neopentyl glycol | 15 mol |
| | Ethylene glycol | 65 mol |
| | Terephthalic acid | 47 mol |
| | Isophthalic acid | 42 mol |
| | Sebacic acid | 11 mol |
| A19 | TCD-M | 20 mol |
| | Neopentyl glycol | 20 mol |
| | Ethylene glycol | 60 mol |
| | Terephthalic acid | 50 mol |
| | Isophthalic acid | 48.5 mol |
| | Sebacic acid | 1.5 mol |
| A20 | TCD-M | 90 mol |
| | Neopentyl glycol | 10 mol |
| | Terephthalic acid | 50 mol |
| | Isophthalic acid | 48.5 mol |
| | Trimellitic acid | 1.5 mol |
| A21 | TCD-M | 50 mol |
| | Neopentyl glycol | 25 mol |
| | Ethylene glycol | 25 mol |
| | Terephthalic acid | 47 mol |
| | Isophthalic acid | 42 mol |
| | Sebacic acid | 11 mol |
| Comparative | Neopentyl glycol | 50 mol |

TABLE A3-continued

| Number | Ingredients | Amount Used |
|---|---|---|
| Example A5 | Ethylene glycol | 50 mol |
| | Terephthalic acid | 47 mol |
| | Isophthalic acid | 42 mol |
| | Sebacic acid | 11 mol |
| Comparative Example A6 | Polyvinyl acetal resin ("S-Lec KS-1" (Trademark) manufactured by Sekisui Chemical Co., Ltd.) | |
| Comparative Example A7 | Vinyl chloride/acryl/styrene copolymer ("Denkalac #400" (Trademark) manufactured by Denki Kagaku Kogyo K.K.) | 9.0 parts |
| | Vinyl chloride/Vinyl acetate copolymer ("#1000" (Trademark) manufactured by Denki Kagaku Kogyo K.K.) | 9.0 parts |
| | Polyester resin ("Vylon 600" (Trademark) manufactured by Toyobo Co., Ltd.) | 2.0 parts |

EXAMPLES A12 TO A21 AND COMPARATIVE EXAMPLES A5 TO A7

Preparation of Heat Transfer Image-Receiving Sheets

A coating liquid for forming a dye-receiving layer, having the following formulation was coated onto one surface of a substrate sheet, synthetic paper "Yupo FRG-150" (Trademark) with a thickness of 150 μm manufactured by Oji-Yuka Synthetic Paper Co., Ltd., by a bar coater in an amount of 5.0 g/m$^2$ on dry basis, and then dried to form a dye-receiving layer on the substrate sheet. Thus, heat transfer image-receiving sheets according to the present invention and comparative ones were respectively obtained.

| Formulation of Coating Liquid: | |
|---|---|
| Polyester resin shown in Table A3 | 10.0 parts |
| Silicone crosslinkable with catalyst ("X-62-1212" (Trademark) manufactured by Shin-Etsu Chemical Co., Ltd.) | 1.0 part |
| Platinum catalyst ("PL-50T" (Trademark) manufactured by Shin-Etsu Chemical Co., Ltd.) | 0.1 parts |
| Methyl ethyl ketone/Toluene (weight ratio = 1:1) | 89.0 parts |

It is noted that when the resin was insoluble in the solvent, a suitable amount of chloroform was used as the solvent.

Preparation of Heat Transfer Sheet

An ink composition for forming a dye-supporting layer, having the following formulation was prepared, and coated onto the surface of a substrate sheet, a polyethylene terephthalate film having a thickness of 6 μm with its back surface imparted with heat-resistivity, by gravure printing in an amount of 1.0 g/m$^2$ on dry basis, and then dried to form a dye-supporting layer on the substrate sheet. A heat transfer sheet was thus obtained.

Formulation of Ink Composition:
Dye having the following formula:

-continued

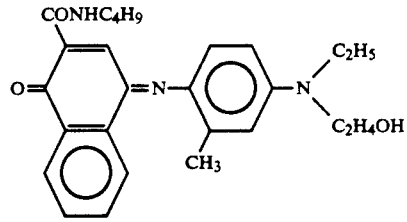

4.00 parts

| | |
|---|---|
| Polyvinyl butyral resin ("S-Lec BX-1"(Trademark) manufactured by Sekisui Chemical Co., Ltd.) | 3.00 parts |
| Methyl ethyl ketone | 46.50 parts |
| Toluene | 46.50 parts |

Heat Transfer Printing Test

Each of the heat transfer image-receiving sheets obtained in Examples A12 to A21 and Comparative Examples A5 to A7 was superposed on the above-obtained heat transfer sheet so that the dye-receiving layer faced the dye-supporting layer. Thermal energy was then applied to the back surface of the heat transfer sheet by a thermal head under the following conditions:

| | |
|---|---|
| Electric voltage applied: | 11.0 V |
| Pulse width: | applied step pattern method, 16 msec/line at outset, reduced stepwise every 1 msec |
| Dot density in sub-scanning direction: | 6 dot/mm (= 33.3 msec/line) |

The cyan images thus obtained were evaluated in terms of the resistance to light, resistance to fingerprint and resistance to plasticizer. The results are shown in Table A4.

TABLE A4

| Example | Total Evaluation | Resistance to Light | Resistance to Fingerprint | Resistance to Plasticizer |
|---|---|---|---|---|
| Example A12 | ◎ | ○ | A | ○ |
| Example A13 | ◎ | ○ | A | ○ |
| Example A14 | ◎ | ○ | A | ○ |
| Example A15 | ◎ | ○ | A | ○ |
| Example A16 | ◎ | ○ | A | ○ |
| Example A17 | ◎ | ○ | A | ○ |
| Example A18 | ◎ | ○ | A | ○ |
| Example A19 | ◎ | ○ | A | ○ |
| Example A20 | ○ | ○ | C | Δ |
| Example A21 | ○ | ○ | C | Δ |
| Comparative Example A5 | Δ | Δ | B | Δ |
| Comparative Example A6 | Δ | ○ | D | x |
| Comparative Example A7 | x | x | D | x |

EXAMPLES A22 TO A25

Preparation of Heat Transfer Image-Receiving Sheets

A coating liquid for forming a dye-receiving layer, having the following formulation was coated onto one surface of a substrate sheet, synthetic paper "Yupo FRG-150" (Trademark) with a thickness of 150 μm manufactured by Oji-Yuka Synthetic Paper Co., Ltd., by a bar coater in an amount of 5. 0 g/m$^2$ on dry basis, and then dried to form a dye-receiving layer on the substrate sheet. Heat transfer image-receiving sheets according to the present invention were thus obtained.

| Formulation of Coating Liquid: | |
|---|---|
| Polyester resin shown in Table A5 | 10.0 parts |
| Silicone crosslinkable with catalyst ("X-62-1212" (Trademark) manufactured by Shin-Etsu Chemical Co., Ltd.) | 1.0 part |
| Platinum catalyst ("PL-50T" (Trademark) manufactured by Shin-Etsu Chemical Co., Ltd.) | 0.1 parts |
| Methyl ethyl ketone/Toluene (weight ratio = 1:1) | 89.0 parts |

It is noted that when the resin was insoluble in the solvent, a suitable amount of chloroform was used as the solvent.

TABLE A5

| | Acid Component | | | | Diol Component | | |
|---|---|---|---|---|---|---|---|
| Example | Terephthalic acid | Isophthalic acid | Trimellitic acid | CHDC | TCD-M | Ethylene glycol | CHDM |
| A17 (Reference) | 50 | 48 | 2 | — | 40 | 60 | — |
| A22 | 50 | 48 | 2 | — | — | 60 | 40 |
| A23 | 60 | 40 | — | — | 60 | 20 | 20 |
| A24 | 30 | 40 | — | 30 | — | 60 | 40 |
| A25 | 50 | 50 | — | — | 50 | 50 | — |

Heat Transfer Printing Test

The same printing test as in Examples A12 to A21 was carried out using each of the heat transfer image-receiving sheets obtained in Examples A22 to A25 and the heat transfer sheet prepared in Examples A12 to A21.

TABLE A6

| Example | Total Evaluation | Resistance to Light 100 KJ/m² | Resistance to Light 200 KJ/m² | Resistance to Fingerprint | Resistance to Plasticizer |
|---|---|---|---|---|---|
| A17 (Reference) | ◎ | ○ | Δ | A | ○ |
| A22 | ◎ | ○ | x | A | ○ |
| A23 | ○ | ○ | Δ | C | Δ |
| A24 | ○ | ○ | x | A | ○ |
| A25 | ○ | ○ | Δ | C | Δ |

The resistance to light, to fingerprint and to plasticizer of the image shown in Tables A4 and A6 were evaluated in accordance with the following manners:

(1) Resistance to Light

The printed image was exposed to a light with an energy of 100 kJ/m² and a wavelength of 420 nm using a xenon fadeometer, "CI-35A" (Trademark) manufactured by Atlas Corp. The optical densities of the image before and after the above exposure were measured by a densitometer, "RD-918" (Trademark) manufactured by MacBeth Corp. The remaining rate of the optical density was calculated from the following equation, and rated against the following standard:

$$\text{Remaining rate (\%)} = [(\text{Optical density before the exposure})/(\text{Optical density after the exposure})] \times 100$$

○: Remaining rate is 85% or more
Δ: Remaining rate is 80% or more but less than 85%
x: Remaining rate is less than 80%

(2) Resistance to Fingerprint

The image-printed surface of the image-receiving sheet was pressed with a finger, and the image-receiving sheet was preserved at room temperature for 5 days. Thereafter, the image-printed surface was visually observed in terms of changes in color and in optical density, and rated against the following standard:

A: Almost no difference was observed between the finger-pressed portion and the finger-nonpressed portion B: Change in color or in optical density was observed C: The color of the image changed fingerprint-wise to white, so that fingerprint was clearly observed D: The color of the image at the finger-pressed portion and its surroundings changed to white, and coagulation of the dye was observed (3) Resistance to Plasticizer The image-recorded surface was rubbed lightly with a commercially available eraser reciprocatingly 5 times. Thereafter, change in optical density of the image was visually observed, and rated against the following standard:

◯: Almost no change in optical density was observed

Δ: Change in optical density was observed x: Remarkable change in optical density was observed, and the color in low- and medium-density areas changed to white According to the present invention, when a dye-receiving layer is formed using a polyester resin which is prepared using an alicyclic compound as at least one of the diol component and the acid component, the resulting heat transfer image-receiving sheet can produce an image having improved fastness properties such as resistance to light, resistance to fingerprint and resistance to plasticizer.

REFERENTIAL EXAMPLE B1

50 parts of dimethylterephthalic acid, 50 parts of dimethylisophthalic acid, 50 parts of ethylene glycol, 50 parts of BPE-20 (bisphenol), and 0.5 parts of tetrabutoxy titanate serving as a catalyst were placed in an autoclave equipped with a thermometer and a stirrer. The mixture was heated to a temperature of 150° to 220° C. for 3 hours to cause transesterification. The temperature of the reaction system was then raised to 250° C. over a period of 30 minutes, and the pressure of the system was gradually reduced to 0.3 mmHg or less over a period of 45 minutes. The reaction was continued for 90 minutes under these conditions, thereby obtaining a light yellow transparent polyester resin.

To 100 parts of the polyester resin thus obtained were added 100 parts of toluene, 5 parts of polyethylene glycol having a molecular weight of 400, 20 parts of isophorone diisocyanate and 0.02 parts by dibutyltin laurate. The mixture was heated to a temperature of 70° to 80° C. for 2 hours. After the mixture was cooled to 70° C., it was diluted with 126 parts of methyl ethyl ketone to terminate the reaction, thereby obtaining a urethane-modified polyester resin having a molecular weight of approximately 42,000.

The polyester resins shown in Table B1 were respectively prepared in the same manner as the above.

TABLE B1

| Number | Ingredients | |
|---|---|---|
| B1 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 5 parts |
| B2 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 10 parts |
| B3 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 15 parts |
| B4 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 20 parts |
| B5 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 30 parts |
| B6 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 300) | 30 parts |
| B7 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 200) | 30 parts |
| B8 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 400) | 15 parts |
| | Polyethylene glycol (molecular weight: 300) | 15 parts |
| B9 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 300) | 10 parts |
| | Polyethylene glycol (molecular weight: 400) | 10 parts |
| B10 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polyethylene glycol (molecular weight: 200) | 15 parts |
| | Polyethylene glycol (molecular weight: 400) | 15 parts |
| B11 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polypropylene glycol (molecular weight: 200) | 30 parts |
| B12 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polytetramethylene glycol (molecular weight: 500) | 30 parts |
| B13 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polybutylene glycol (molecular weight: 500) | 30 parts |
| B14 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Polycaprolactone (molecular weight: 1,000) | 30 parts |
| Comparative Example B1 | Ethylene glycol | 50 parts |
| | BPE-20 (bisphenol) | 50 parts |
| | Terephthalic acid | 50 parts |
| | Isophthalic acid | 50 parts |
| Comparative Example B2 | Ethylene glycol | 50 parts |
| | BPE-20 (bisphenol) | 50 parts |
| | Terephthalic acid | 50 parts |
| | Isophthalic acid | 50 parts |
| | Isophorone diisocyanate | 20 parts |
| | Neopentyl glycol | 10 parts |

EXAMPLES B1 TO B14 AND COMPARATIVE EXAMPLES B1 AND B2

Preparation of Heat Transfer Image-Receiving Sheets

A coating liquid for forming a dye-receiving layer, having the following formulation was coated onto one surface of a substrate sheet, synthetic paper with a thickness of 110 μm manufactured by Oji-Yuka Synthetic Paper Co., Ltd., by a wire bar in an amount of 5.0 g/m$^2$ on dry basis, dried, and hardened to form a dye-receiving layer on the substrate sheet. Thus, heat transfer image-receiving sheets according to the present invention and comparative ones were respectively obtained.

| Formulation of Coating Liquid: | |
|---|---|
| Urethane-modified polyester resin shown in Table B1 | 13.4 parts |
| Amino-modified silicone ("KF-393" (Trademark) manufactured by Shin-Etsu Chemical Co., Ltd.) | 0.25 parts |
| Epoxy-modified silicone ("X-22-343" (Trademark) manufactured by Shin-Etsu Chemical Co., Ltd.) | 0.25 parts |
| Methyl ethyl ketone/Toluene | 84.8 parts |

-continued

| Formulation of Coating Liquid: |
|---|
| (weight ratio = 1:1) |

Preparation of Heat Transfer Sheet

An ink composition for forming a dye-supporting layer, having the following formulation was prepared, and coated onto the surface of a substrate sheet, a polyethylene terephthalate film having a thickness of 6 μm with its back surface imparted with heat-resistivity, by a wire bar in an amount of 1.0 g/m² on dry basis, and then dried to form a dye-supporting layer on the substrate sheet. A heat transfer sheet was thus obtained.

| Formulation of Ink Composition: | |
|---|---|
| C.I. Disperse Blue 24 | 1.0 part |
| Polyvinyl butyral resin | 10.0 parts |
| Methyl ethyl ketone/Toluene (weight ratio = 1:1) | 90.0 parts |

Heat Transfer Printing Test

Each of the heat transfer image-receiving sheets obtained in Examples B1 to B14 and Comparative Examples B1 and B2 was superposed on the above-obtained heat transfer sheet so that the dye-receiving layer faced the dye-supporting layer. Thermal energy was then applied to the back surface of the heat transfer sheet by a thermal head under the following conditions:

| | |
|---|---|
| Electric voltage applied: | 12.0 V |
| Pulse width: | 16 msec |
| Dot density: | 6 dot/line |

The images thus obtained were evaluated in terms of the resistance to fingerprint and resistance to plasticizer in accordance with the following manners. The results are shown in Table B2.

(1) Resistance to Fingerprint

The image-printed surface of the image-receiving sheet was pressed with fingers deposited with facial sebum, and the image-receiving sheet was preserved at a temperature of 40° C. for 48 hours. Thereafter, the image-printed surface was visually observed, and rated against the following standard.

○: No fingerprint was observed
Δ: Fingerprint was slightly observed
x: Fingerprint was clearly observed

(2) Resistance to Plasticizer

Vaseline containing 10% of dioctylphthalate was applied to the image-printed surface of the image-receiving sheet, and the image-receiving sheet was preserved at a temperature of 40° C. for 48 hours. Thereafter, the image-printed surface was visually observed, and rated against the following standard.

○: Observed no change
Δ: Slightly faded in color
x: Remarkably faded in color

TABLE B2

| Image-Receiving Sheet | Resin | Resistance to Fingerprint | Resistance to Plasticizer |
|---|---|---|---|
| Example B1 | 1 | Δ | Δ |
| Example B2 | 2 | Δ | Δ |
| Example B3 | 3 | ○ | Δ |

TABLE B2-continued

| Image-Receiving Sheet | Resin | Resistance to Fingerprint | Resistance to Plasticizer |
|---|---|---|---|
| Example B4 | 4 | ○ | Δ |
| Example B5 | 5 | ○ | ○ |
| Example B6 | 6 | ○ | Δ |
| Example B7 | 7 | Δ | Δ |
| Example B8 | 8 | ○ | ○ |
| Example B9 | 9 | ○ | ○ |
| Example B10 | 10 | ○ | ○ |
| Example B11 | 11 | Δ | ○ |
| Example B12 | 12 | Δ | ○ |
| Example B13 | 12 | Δ | ○ |
| Example B14 | 12 | ○ | ○ |
| Comparative Example B1 | 1 | x | x |
| Comparative Example B2 | 2 | x | x |

What is claimed is:

1. A heat transfer image-receiving sheet comprising: a substrate sheet; and a dye-receiving layer provided on at least one surface of the substrate sheet and comprising a polyester resin containing a diol component and an acid component, at least the diol component comprising tricyclodecanedimethanol.

2. A heat transfer image-receiving sheet as set forth in claim 1, wherein said acid component comprises cyclohexanedicarboxylic acid.

3. A heat transfer image-receiving sheet as set forth in claim 1, wherein the polyester resin has a number-average molecular weight of 2,000 to 30,000.

4. A heat transfer image-receiving sheet as set forth in claim 1, wherein the mixture contains at least 60 mol % of ethylene glycol.

5. A heat transfer image-receiving sheet as set forth in claim 1, wherein the dye-receiving layer further comprises a polyurethane resin.

6. A heat transfer image-receiving sheet as set forth in claim 5, wherein the diol component of the polyurethane resin comprises a compound having the following formula:

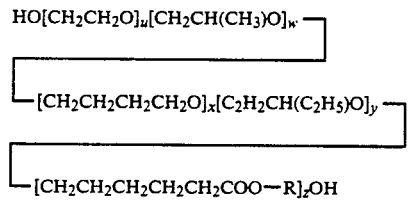

wherein u, w, x, y and z respectively represent an integer of 0 to 10, provided that at least one of u, w, x, y and z is not 0, and R is an alkylene group, a phenylene group or an alkylene oxide group.

7. A heat transfer image-receiving sheet as set forth in claim 6, wherein the polyurethane resin and the polyester resin are in a chemically bonded state.

8. A heat transfer image-receiving sheet as set forth in claim 6, wherein the polyurethane resin and the polyester resin are in a mixed state.

9. A heat transfer image-receiving sheet as set forth in claim 6, wherein the polyurethane resin and the polyester resin are in a weight ratio of 100:(10 to 50).

10. A composite assembly to be thermally printed by a thermal printing means, said assembly comprising (i) a heat transfer sheet comprising a substrate and a dye layer formed thereon and (ii) a heat transfer image-receiving sheet comprising a substrate sheet and a dye-receiving layer provided on at least one surface of the substrate sheet, the dye-receiving layer comprising a polyester resin containing a diol component and an acid component, the diol component comprising at least tricyclodecanedimethanol.

* * * * *